United States Patent [19]

Haglund et al.

[11] Patent Number: 4,920,884

[45] Date of Patent: May 1, 1990

[54] SELECTABLE LIGHTWEIGHT ATTACK MUNITION

[75] Inventors: Stephen A. Haglund, Minnetonka; Peter H. Van Sloun, Hopkins, both of Minn.

[73] Assignee: Honeywell Inc., Minneapolis, Minn.

[21] Appl. No.: 256,437

[22] Filed: Oct. 12, 1988

[51] Int. Cl.[5] ..... F42C 15/14; F42C 15/40

[52] U.S. Cl. ..... 102/215; 102/265; 102/270; 102/427

[58] Field of Search ..... 102/215, 265, 270, 401, 102/426, 427

[56] References Cited

U.S. PATENT DOCUMENTS

| | | | |
|---|---|---|---|
| 3,568,601 | 3/1971 | Morrow | 102/215 |
| 3,703,145 | 11/1972 | Burkhardt et al. | 102/270 |
| 4,712,479 | 12/1987 | Babel | 102/215 |
| 4,712,480 | 12/1987 | Lindstadt et al. | 102/215 |
| 4,854,239 | 8/1989 | Van Sloun | 102/426 |

*Primary Examiner*—Charles T. Jordan

*Attorney, Agent, or Firm*—Roger W. Jensen

[57] ABSTRACT

This portable munition system has multiple modes of operation with the sensor inputs, output actuator circuits, and timing requirements determined by the control electronics. A self-check is performed initially before the munition can be armed. An indicator light driven by the electronics circuitry provides status information to the operator. The warhead can be aimed with integral sights.

24 Claims, 7 Drawing Sheets

42
BATTERY
266
VEHICLE DETECTION
200
CONTROL ELECTRONICS
244
FIRING CIRCUITS
INDICATOR LIGHT
47
ANTI-DISTURBANCE SWITCH
254
SELECTOR SWITCH
248
TRIPLINE SWITCH
258

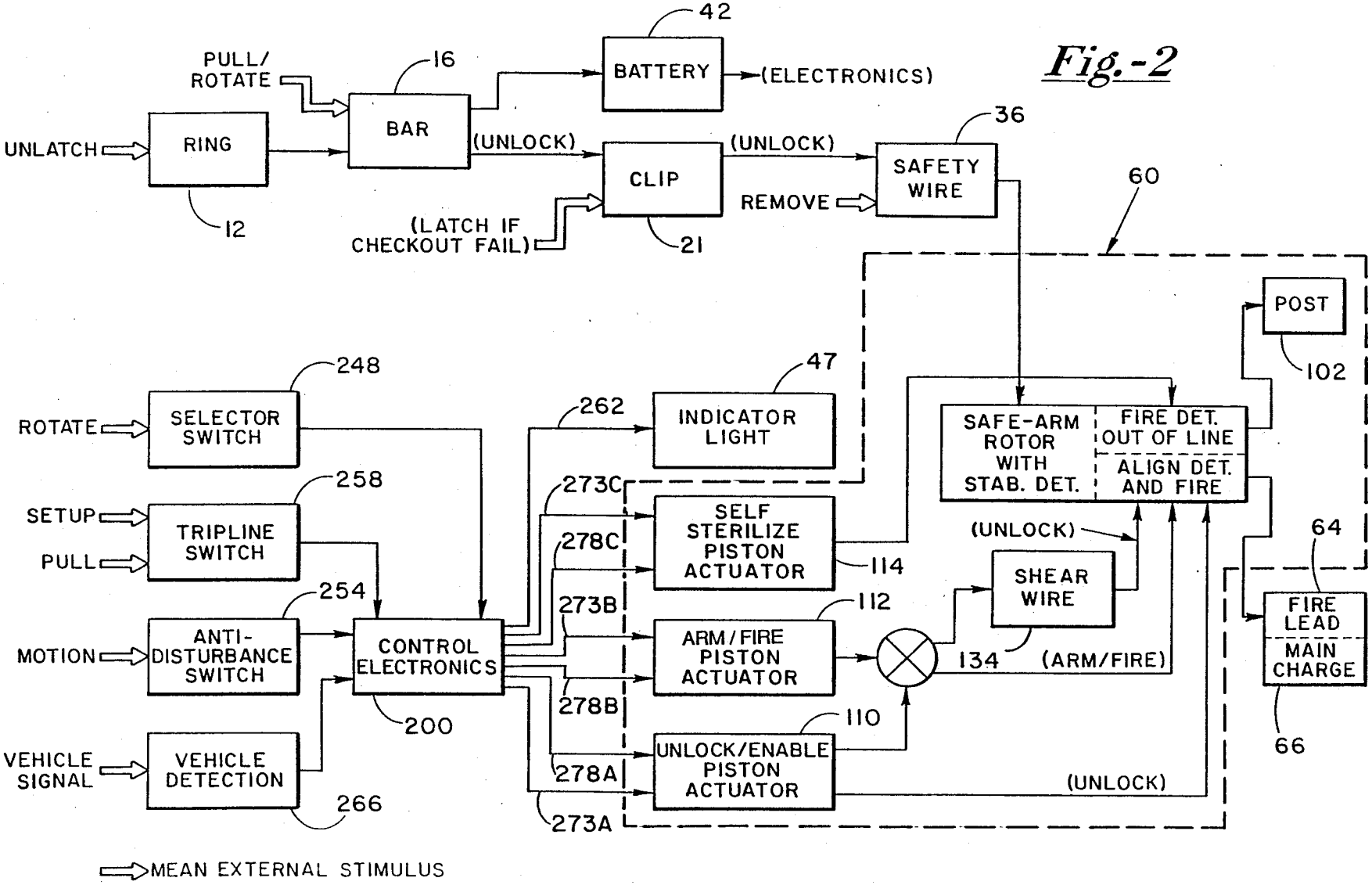
Fig.-2
UNLATCH
PULL/ ROTATE
RING
12
BAR
16
(UNLOCK)
(LATCH IF CHECKOUT FAIL)
CLIP
21
REMOVE
(UNLOCK)
SAFETY WIRE
36
(ELECTRONICS)
BATTERY
42
60
POST
102
SAFE-ARM ROTOR WITH STAB. DET.
FIRE DET. OUT OF LINE
ALIGN DET. AND FIRE
(UNLOCK)
SHEAR WIRE
134
(ARM/FIRE)
(UNLOCK)
64
FIRE LEAD
MAIN CHARGE
66
INDICATOR LIGHT
47
SELF STERILIZE PISTON ACTUATOR
114
ARM/FIRE PISTON ACTUATOR
112
UNLOCK/ENABLE PISTON ACTUATOR
110
262
273C
278C
273B
278B
278A
273A
CONTROL ELECTRONICS
200
SELECTOR SWITCH
248
TRIPLINE SWITCH
258
ANTI-DISTURBANCE SWITCH
254
VEHICLE DETECTION
266
ROTATE
SETUP
PULL
MOTION
VEHICLE SIGNAL
MEAN EXTERNAL STIMULUS (CLOCK AND RESET LINES NOT SHOWN FOR SIMPLIFICATION)

ELECTRONIC DATA FLOW/COMPUTATION BLOCK DIAGRAM

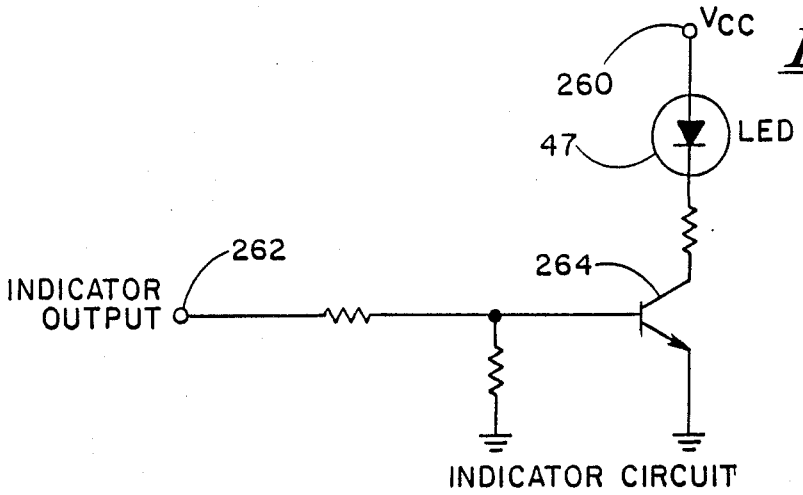
Fig.-8
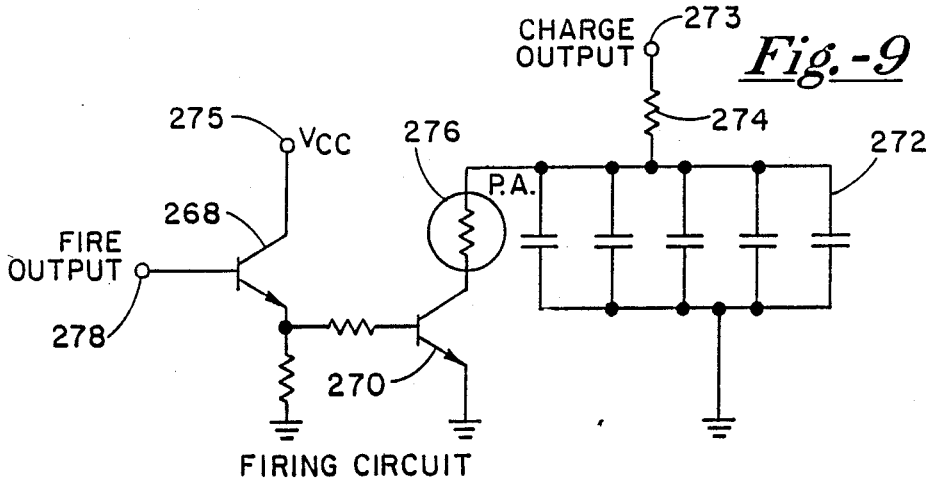
Fig.-9
Fig.-10
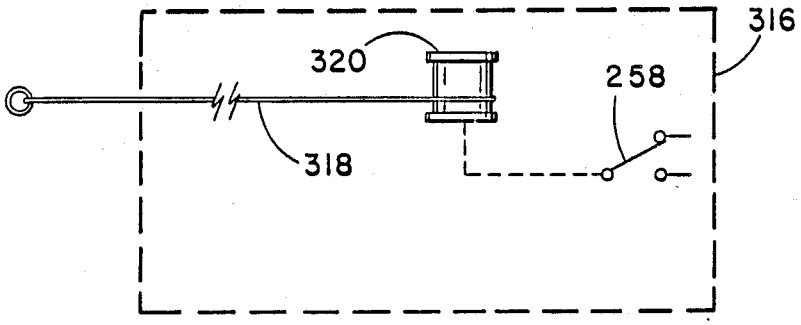

SELECTABLE LIGHTWEIGHT ATTACK MUNITION

FIELD OF THE INVENTION

This invention relates to portable munitions such as hand grenades, pocket mines, and similar munitions.

REFERENCE TO RELATED APPLICATIONS

This application is related to the following commonly assigned applications filed concurrently herewith:

| Title | Ser. No. |
|---|---|
| Self-Sterilizing Safe-Arm Device with Arm/Fire Feature | 07/256,445 |
| Safety Locking Pull Ring | 07/256,444 |

BACKGROUND OF THE INVENTION

This invention is an overall portable munition system having an electronic control portion, mechanics for activation and providing either safing or arm/firing and a warhead. This munition provides for multiple modes of operation utilizing selectable inputs to obtain any of a plurality of outputs.

SUMMARY OF THE INVENTION

A compact portable explosive munition utilizes electronics for performing computations, timing, selecting inputs and outputs utilizing digital logic contained on a gate array along with additional electrical components to provide input and output signals matched to the gate array along with tests and switching functions not achievable by gate circuitry. A multistep arm fire procedure, a safing or self-sterilizing procedure, a comprehensive self-test procedure, and multiple operating modes, mine, tripline, or time delay, are provided. The modes are switch selected.

This apparatus also provides boresight and off boresight aiming capability, a stowed tripline for tripline firing, and an alternate mode of firing the munition using a blasting cap before or after the munition has been self-sterilized.

A captive ring must be freed and used to rotate a bar to free one end of a safety wire and to energize a battery to power the electronics as first steps in firing the munition. The ring and associated parts were the subject of a commonly assigned copending application discussed earlier.

A rotor which can be either translated or rotated by explosive piston actuators which are fired by electrical currents controlled by the electronic computation, provides additional safety features for either arming and firing or in safing the munition. This rotor was also the subject of a separately commonly assigned copending application and discussed earlier.

A main charge explosive is used to form and hurl a warhead projectile.

BRIEF DESCRIPTION OF THE DRAWINGS

FIG. 2: Functional block diagram

FIG. 8: Indicator Circuit

FIG. 9: Firing Circuit

FIG. 10: Tripline and switch schematic

DETAILED DESCRIPTION OF THE PREFERRED EMBODIMENT

Figure 1:
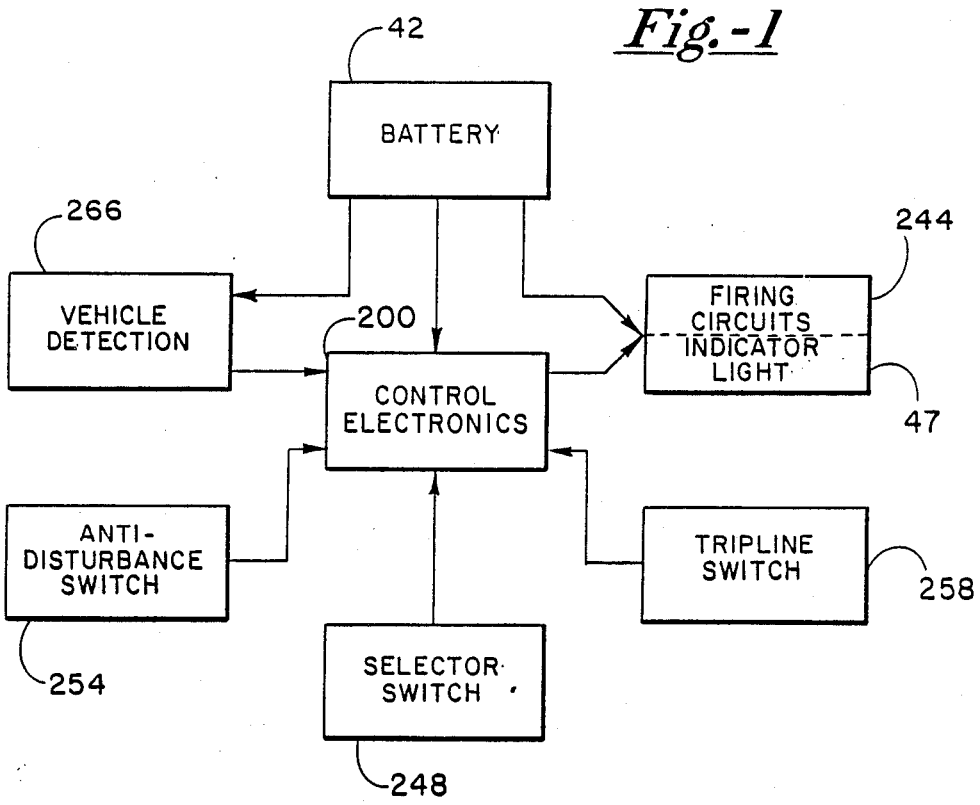
FIG. 1: Electronics block diagram

Overview of Munition Operation:

An electronics block diagram of the munition is shown in FIG. 1. Battery 42 provides power for the entire system. The system mode of operation is determined by selector switch 248 and whether a tripline is deployed to activate switch 258 or not. Inputs vehicle detection 266 and anti-disturbance switch 254 are selected by the mode of operation. Control electronics 200 uses a custom gate array to provide timing functions, logic functions, and all other control requirements. Firing circuits 244 fire the explosive pistons to operate the munition. Indicator light 47 indicates a functional and safe condition to the operator.

In FIG. 2 a functional block diagram utilizing these and other electronic elements along with mechanical elements of the overall munition are shown. This diagram includes elements from two other copending applications referred to earlier. Reference numbers of identical parts or elements of these applications have the same reference numbers here. The process of unlatching ring 12, then using the ring to pull and rotate activation bar 16 to energize battery 42, the observation of indicator light 47 to determine whether to secure the end of safety wire 36 with clip 21 or remove the wire are covered in a copending patent application on a safety locking pull ring.

Prior to energizing indicator light 47, control electronics 200 must perform a successful self-check routine and only after successful completion of the self-check routine is the indicator light energized. Control electronics 200 also reads the status of selector switch 248, tripline switch 258, monitors motion of munition itself with antidisturbance switch 254, monitors vehicle presence with vehicle detection block 266 and tests for low voltage. As mentioned, the operating mode of the system is determined by the states of selector switch 248 and tripline switch 258 which states are used by control electronics 200 to select the proper input signals, set the mode of operation, and set the timed event. When control electronics 200 determines that it is time to enable it sends an electrical signal to piston actuator 110 which unlocks the rotor and enables the arm/fire mechanism. When control electronics 200 determines that self-sterilization is required it sends an electrical signal to piston actuator 114 which fires the detonator to translate the rotor and extend post 102. When control electronics 200 determines that main charge 66 should be fired, an electrical signal is sent to piston actuator 112 to rotate the rotor, which fires the detonator which fires transfer lead 64, which in turn fires main charge 66, also shown in FIGS. 3, 4, 5, and 6. The operation of safe and arm/fire mechanism 60, shown in dashed outline, is covered in a copending application on self-sterilizing safe arm device with arm/fire feature.

This overview describes the mechanical and electrical interrelationship between the two copending patents and this apparatus which cooperate to provide the complete sequence of operations for the munition.

Figure 3:
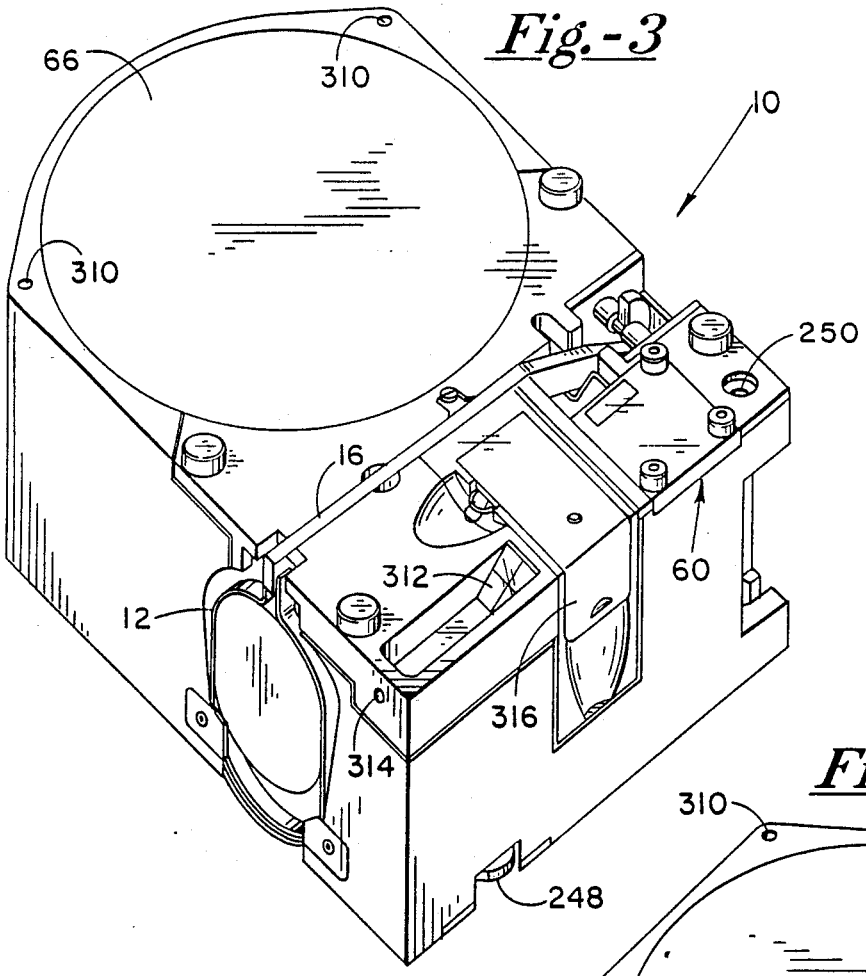
FIG. 3: Munition perspective showing external features

In FIG. 3, two boresight holes 310 are shown, both of which extend completely through munition 10, to permit aiming main charge 66 by sighting through either of these holes. Reflecting surface 312 is set at a 45 degree angle with respect to the warhead 66 axis of projection and with respect to hole 314. This arrangement permits using hole 314 to aim warhead 66 by looking through hole 314 when the munition is mounted with holes 310 not accessible for sighting. A tripline mounted within housing 316 in munition 10 is used in a tripline mode of operation to be discussed later. Selector switch 248 has an exposed selector knob to allow the operator to set in the various system parameters. Switch 248 and the tripline condition are used by the operator to program munition 10 prior to use.

Selector switch 248 is a rotary switch which has eight labeled settings. These settings are 4, 10, 24, 15, 30, 45, 60, and 'S.' When either 4, 10, or 24 is set this provides a self-sterilize time delay of that many hours. These numbers are color coated light green on a white background. When either 15, 30, 45, or 60 is set this provides a firing time delay of that many minutes. These numbers are color coded red on a white background. The 'S' is a safe setting and is white on a green background. The safe setting is provided to prevent compete activation of the electronics and is processed as a self-check failure. Tripline switch 258 is a single pole double throw switch wired before deployment with one contact open and one contact closed which is reversed when the tripline is deployed. Control electronics 200 reads this change as an indication that tripline 316 is activated. A pull on a tripline 318 of FIG. 10 after this deployment results in the switch being tripped to the state before deployment which is interpreted as a fire command in the tripline mode discussed later. In the following Table 1 the three modes of operation of the munition, namely, mine mode, tripline mode, and time delay mode are shown corresponding to the setting of selector switch 248 and the deployment of tripline switch 258. Logic in control electronics 200 interprets these switch settings and sets up the corresponding operational mode.

TABLE 1

FUNCTIONAL MATRIX

| | Operational Mode | | | |
|---|---|---|---|---|
| | | Trip Line Mode | | Time |
| Conditions | Mine Mode | Self Sterilize | Fire | Delay Mode |
| Selector Switch 248 Setting | 4, 10 or 24 hours | 4, 10 or 24 hours | 15, 30, 45 or 60 minutes | 15, 30, 45 or 60 minutes |
| Tripline Switch 258 Setting | Inactive | Active | Active | Inactive |

The systems inputs and response for the operational modes specified by the switch settings are shown in Table 2. The system first becomes activated by the battery and is enabled approximately 60 second after activation. The system's inputs and operation for the various modes follow.

Mine Mode Operation, Self-Sterilize Time Out—4, 10, or 24 Hours

Vehicle detection block 266, shown in FIG. 2, has a magnetic pick-up, analog amplification, and logic elements to determine the passing of a vehicle. The output from vehicle detection block 266 is simply a binary one or zero. This is read by control electronics 200 only when in the mine mode. When the system is enabled a passing vehicle will fire the munition.

A change in state of tripline switch 258 will fire the munition in the mine mode after the system is enabled. This occurs because even though the primary mine mode input signal is vehicle detection block 266, a change in tripline switch 258 is interpreted as an attempt to tamper with the munition which causes the munition to fire regardless of the mode of operation. This is shown in Table 2 opposite the tamper input.

The munition will self-sterilize 4, 10, or 24 hours after activation, whichever time was set on selector switch 248 provided the vehicle detection 266 signal was not received within that length of time after the system was enabled. The munition will self-sterilize at any time after battery activation if a low voltage or timer error have occurred.

The munition will fire if tampering is detected by a change in selector switch 248 after the system is enabled as discussed earlier.

The munition will also fire if the munition is disturbed as indicated by antidisturbance switch 254 after the system is enabled.

TABLE 2

| | Operational Mode | | | |
|---|---|---|---|---|
| | | Trip Line Mode | | Time |
| System Inputs | Mine Mode | Self Sterilize | Fire | Delay Mode |
| Vehicle Detection 266* | Fire | No Effect | No Effect | No Effect |
| Tripline Inputs* (Switch 258 Change) | Fire | Fire | Fire | Fire |
| TIme Set Expired | Self Sterilize | Self Sterilize | Fire | Fire |
| Low Voltage Detection | Self Sterilize | Self Sterilize | Before 15 min. Self Sterilize; After 15 min. Fire | Before 15 min. Self Sterilize; After 15 min. Fire |
| Timer Error | Self Sterilize | Self Sterilize | Self Sterilize | Self Sterilize |
| Tamper Input* (Switch 248 or 258 Change) | Fire | Fire | Fire | Fire |

TABLE 2-continued

| | Operational Mode | | | |
|---|---|---|---|---|
| | | Trip Line Mode | | Time |
| System Inputs | Mine Mode | Self Sterilize | Fire | Delay Mode |
| Anti-Disturbance Switch 254* | Fire | Fire | Fire | Fire |

*Input read only after control electronics 200 has enabled system.

Antidisturbance switch 254 is a switch arranged to momentarily close whenever the munition is moved and provides a binary input which can be read by control electronics 200. This will be described further later.

Tripline Mode, Self-Sterilize Time-Out—4, 10, or 24 Hours

Vehicle detection block 266 is not read by control electronics 200 in this mode. Tripline switch 258 is the primary input and will fire the munition if a change in state of the tripline switch occurs. This change is interpreted as both the primary system input and also as a tamper input.

Control electronics 200 will self-sterilize the munition after the time set in switch 248, 4, 10, or 24 hours, has expired. The munition will also self-sterilize if a low voltage condition or timer error is detected.

Control electronics 200 will fire the munition if a tamper input, described earlier, or antidisturbance switch 254 signal occurs after system enable.

Tripline Mode, Fire Time-Out—15, 30, 45, or 60 Minutes

Vehicle detection block 266 is not read by control electronics 200 in this mode. A change in state of tripline switch 258 will fire the munition and be interpreted both as the primary system input and as a tamper input as in the self-sterilize tripline mode.

Control electronics 200 will fire the munition after the time set in switch 248, 15, 30, 45, or 60 mintues has expired. A low voltage condition will result in self-sterilization if the condition occurs before 15 minutes have elapsed and after 15 minutes have elapsed will result in the munition being fired. A timer error will result in the self-sterilization of the munition at any time.

A tamper input detection or antidisturbance switch 254 input will cause the munition to fire any time afer enable.

Time Delay Mode, Fire Time-Out—15, 30, 45 or 60 Minutes

Vehicle detection block 266 is not read by control electronics 200 in this mode. The antidisturbance switch 254 is not read by control electronics 200 in this mode. A change in state of tripline switch 258 will cause the munition to fire as a tamper input. The primary system input is a timing signal generated in control electronics 200 with the interval selected by the selector switch 248 setting. When the time set on selector switch 248, 15, 30, 45, or 60 minutes has expired the munition will fire.

A low voltage condition before 15 minutes have elapsed after activation will cause the munition to be self-sterilized and after 15 minutes will cause the munition to be fired. A time error at any time will cause the munition to be self-sterilized.

A tamper error after enable will cause the unit to fire.

Command Detonate Mode

A separate mode of operation is also available which does not utilize any of the previously described fuze portion of the system. This mode is available at any time before the munition is fired, including after the munition has self-sterilized, because the regular munition detonator is not used. This mode utilizes either a standard military electric or nonelectric blasting cap which fits within hole 250 and is seated within recess 230, shown in FIGS. 3, 4, and 6, and is secured in place by a flexible rubber collet 252 which fits within the hole. The recess 230 is adjacent to the transfer lead 64. When a blasting cap is set off in recess 230, whether electric or nonelectric, the transfer lead will fire which, in turn, will set off the main charge.

Control Electronics Inputs

Figure 7:
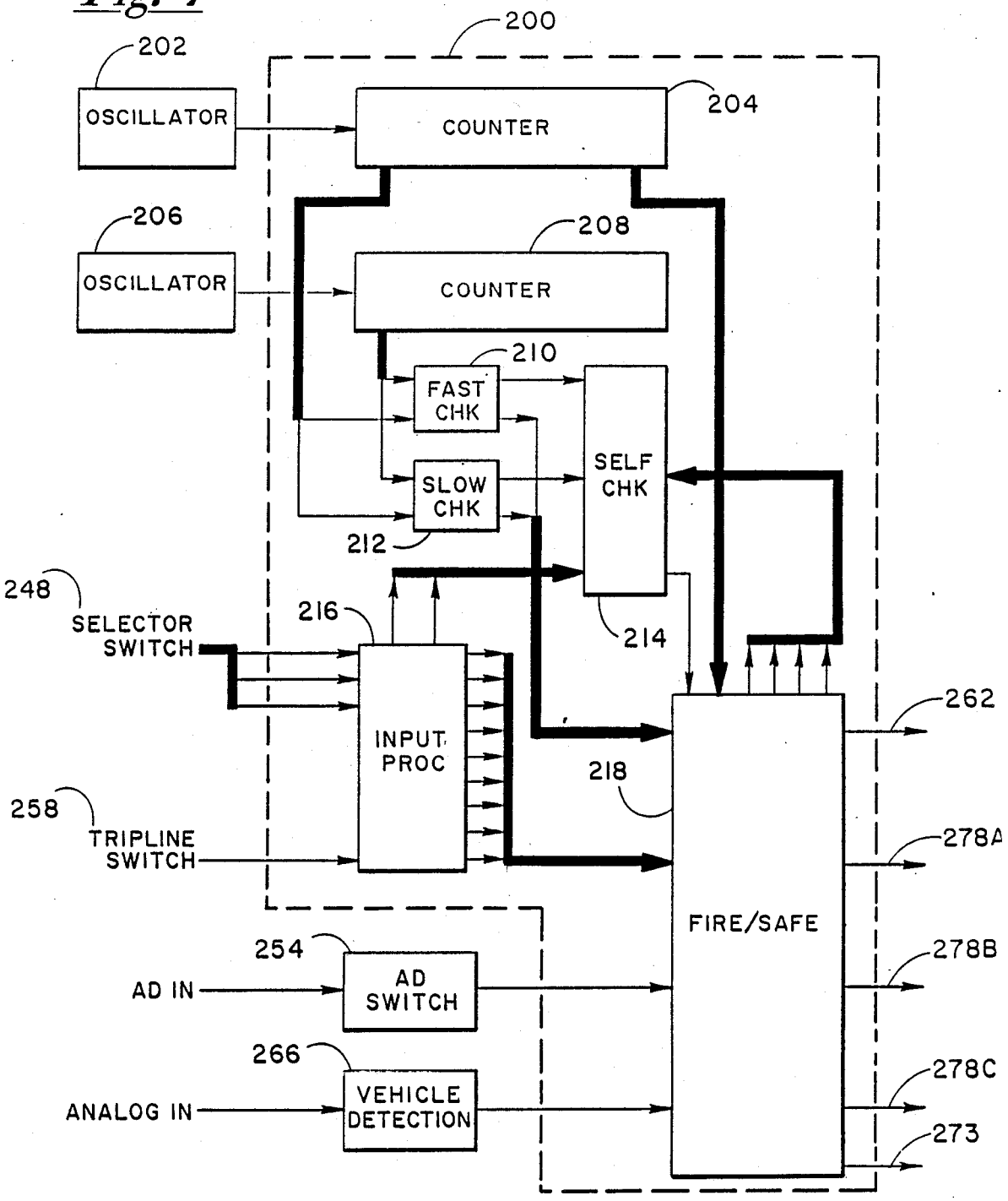
FIG. 7: Electronic Data Flow/Computation Block Diagram

In FIG. 7 control electronics block 200 along with the associated input and output circuits are shown. Oscillator 202 drives counter 204 and oscillator 206 drives counter 208. A fast check block 210 and slow check block 212 receive inputs from both of these counters and the results of these checks are fed to self-check block 214. Input processor block 216 receives inputs from selector switch 248 and tripline switch 258 and has outputs to fire/safe block 218. Antidisturbance switch 254 and vehicle detection 266 also have outputs to fire/safe block 218. Control electronics 200 provides logic to select the interconnections and functions shown in Table 2, described earlier, from the switch setting information shown in Table 1.

Oscillator 202 is reference for the clock of control electronics 200 while oscillator 206 provides a comparison check on the accuracy of oscillator 202. Both oscillators are quartz controlled oscillators with the same nominal frequency. This comparison will be covered in the self-check description.

Input processor 216 provides two general functions. It latches the state of the selector switch 248 and tripline switch 258 shortly after the system is energized to permit detecting any changes in the state of the input switches that may occur after the munition is enabled. In addition, a comparison is made of the input switches latched data to the input signals themselves immediately after these signals are latched. Any changes in these input switch states will generate the tamper signal, discussed earlier, which is sent to the fire/safe block 218. If this comparison indicates identical settings this shows that the inputs were successfully latched and constitutes one of the system self-checks. These switch conditions are binary coded signals from the selector switch which are decoded into discrete enable signals and sent to the fire control section. In this manner, all the information provided by the input switches is converted to the form used by other logic blocks.

Antidisturbance switch 254 utilizes timing and logic in block 218 which sends a fire signal whenever a disturbance is detected.

Figure 6:
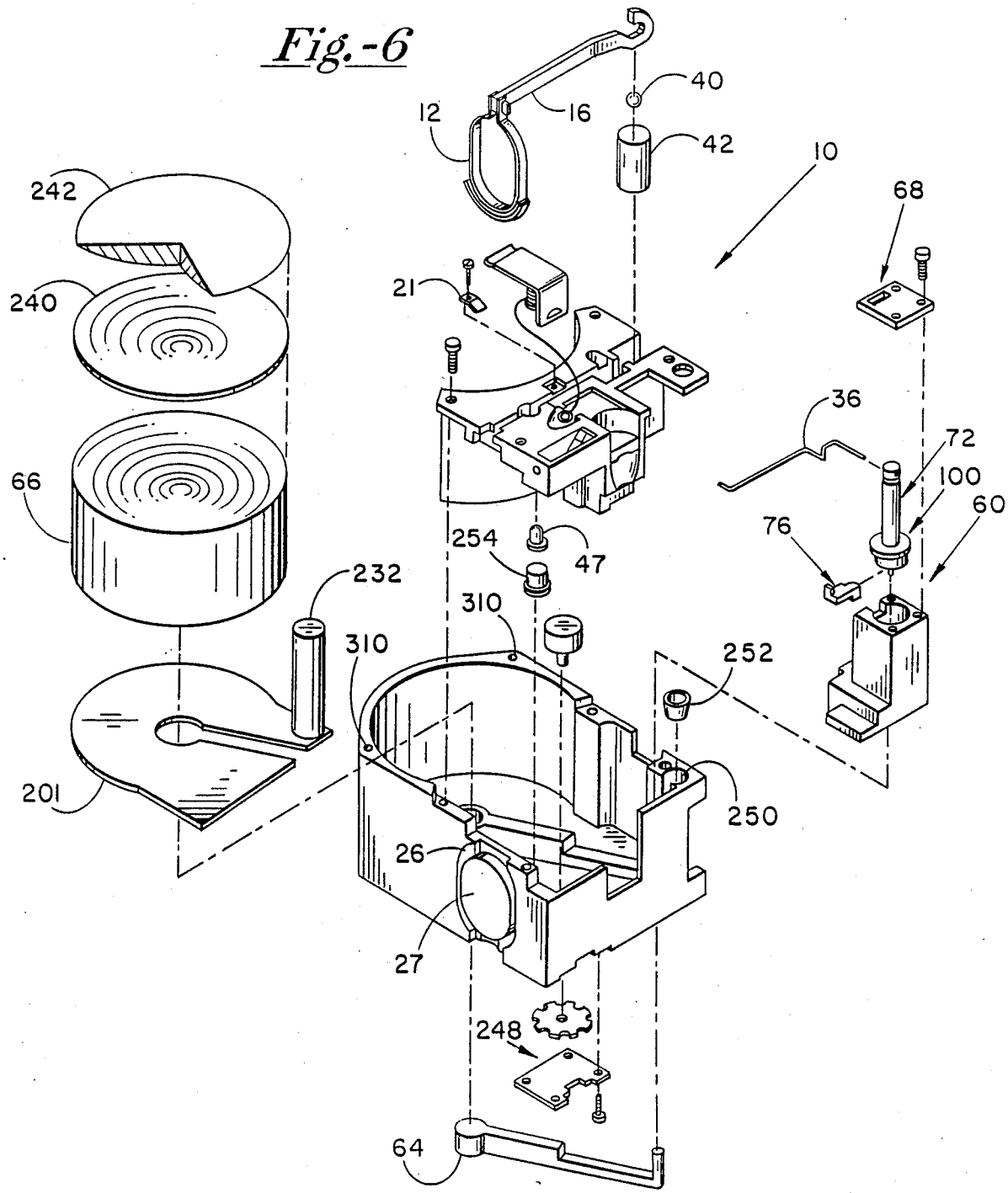
FIG. 6: Exploded view of munition

Vehicle detection 266 utilizes a coil 232, shown in FIG. 6, sensitive to magnetic field changes along with logic to accurately determine when a vehicle is passing by. A binary signal is sent to fire/safe block 218 whenever a vehicle is detected.

Control Electronics Functions

Counter 204 and counter 208 consist of a number of counter blocks with each block having six stages of ripple counters. Each block has six binary outputs with each successive output stage changing at one half the frequency of the previous output. A number of these blocks are connected together consecutively to provide all of the timing functions previously discussed. Any given time interval required by the system is obtained by monitoring the appropriate block and stage of counter 204 to obtain the time interval which is based upon the known oscillator 202 frequency.

Fast check 210 compares the frequency of signals from the oscillator 202 time base counter 204 to the frequency of signals from the oscillator 206 time base counter 208. This is done by comparing counts from each counter taken over the same time interval. If the difference between the frequencies is such that oscillator 202 is more than 10 percent faster than that of the oscillator 206 a signal is sent to the self-check block 214 and the fire/safe block 218. If this failure occurs immediately following system initialization the test will indicate a self-check failure. If this failure occurs after enable, the fire control section will indicate a timer error as in Table 2.

Slow check 212 is similar to the fast check block excepting that here if oscillator 202 is 10 percent slower than oscillator 206 a failure is indicated. This failure output also goes to both the self-check and fire control sections, and is treated the same as a fast check failure.

Self-check 214 performs the following self-checks as soon as the system is energized:

Oscillator 202 and oscillator 206 are tested to determine if they differ from each other by less than 10 percent. This process is performed by fast check 210 and slow check 212 as described.

Tests are performed to determine if the battery voltage is above 3 volts. A conventional voltage comparator determines this. A voltage which is equal to or less than 3 volts constitutes self-check failure.

The explosive piston actuator circuits are tested for missing or open circuited actuators. A test pulse is sent to the piston actuators through resistors to limit the current to a value which will not fire the actuators. The amount of voltage drop across the resistors in the circuits from control electronics 200 to each piston actuator is monitored by voltage comparators to determine if any piston actuator is missing or is open circuited. Either missing or open constitutes a self-check failure.

Tripline switch 258 contacts are checked to insure that one contact is closed and one contact is open. If both contacts are of the same state an error condition exists which constitutes a self-check failure. This utilizes the fact that tripline switch 258 has one pole and two contacts and the contacts should always have opposite states.

Selector switch 248 is read to determine whether or not it is set to safe. If the switch is set to safe a self-check failure is indicated and a signal is sent to discontinue the enable sequence.

The voltage across capacitors 272, FIG. 9, which provide energy for firing each piston actuator is tested to determine if the voltage is less than 0.6 volt using a voltage comparator. If the voltage across the capacitors exceeds 0.6 volt an error exists which constitutes a self-check failure. The significance of this voltage level will be discussed later in the fire circuit explanation.

The outputs to the fire and self-sterilize circuits are tested to determine if either is activated. If either is activated a self-check failure is indicated.

The status of selector switch 248 and tripline 258 are tested and compared with the latched value obtained at power up. Any differences in these readings indicate a self-check failure condition.

Control electronics 200 automatically enters the self-test routine once battery 42 has been energized. This self-check routine is completed in approximately 5 seconds. If all tests check out successfully, then indicator light 47 is turned on for 50 seconds at the end of which time the light is flashed on and off for 10 seconds after which time the light is turned off to indicate to the operator that the munition is enabled and in a condition to fire. A flashing indicator light is used to indicate to the operator that the munition will arm within ten seconds which allows him time to obtain a safe distance. If the self-check routine detects a failure then light 47 is never turned on and a resistor is connected across the battery to discharge it and terminate all electronics functions permanently. A fail safe design uses a lack of indication for a failure condition rather than an indicator output which prevents any failure in an indicator light or circuit itself from falsely indicating a safe condition. Only after indicator light 47 is turned on is safety wire 36 removed by the operator to commit the munition to either a self-sterilize or a firing mode of operation. This is normally done soon after light 47 comes on and within the 50 second interval but before it begins to flash.

Control Electronics Circuitry

A custom gate array logic chip is used in control electronics 200 to perform all the decoding and timing functions required as shown in Table 2 and described for FIG. 7. The outputs from control electronics 200 drive piston actuator firing circuitry and an indicator light circuit as shown in FIG. 2. These output circuits and certain other elements described earlier use electronic elements which are not provided by the gate array logic chip. These other elements have been described functionally and are readily available. On the gate array logic chip logic trees provide the selected input and output signals for the various modes as specified in Table 2. The binary count down chains described earlier are readily achievable on this size logic chip and provide all of the timing elements. All electronics elements are mounted on a printed circuit board 201 shown in FIG. 6.

Indicating light 47 circuit is shown in FIG. 8. Line 260 is connected to battery 42. Line 262 is connected to control electronics 200 as shown in FIG. 2 and 7. The resistors in this circuit and transistor 264 are selected to permit driving the light emitting diode as indicator light 47.

A firing circuit used in each of the three explosive piston actuators is shown in FIG. 9 with resistor 274 and firing capacitors 272 being common to the three circuits. Three of these circuits are provided between control electronics 200 and each piston actuator 110, 112, and 114 and are controlled by lines 278A, 278B, and 278C respectively and powered by line 273 as shown in FIGS. 2 and 7. These lines are represented by line 278 and line 273 in FIG. 9 as representative of all three circuits. Resistor 274 has a value which will permit charging capacitors 272 with line 273 when driven by a gate in control electronics 200 to provide the current source. While the current provided by a logic gate output is only on the order of a few milliamps, capacitors 272 integrate this energy to the level necessary to fire a piston actuator. Resistor 276 represents the electrical resistance of a bridge wire in each respective piston actuator used to fire the actuator. Fire output 278 represents the output control lines from three separate gates in control electronics 200 to each firing circuit 278A, 278B, and 278C for the piston actuators.

The resistors associated with transistor 268 and 270 are selected such that a gate output in control electronics 200 can drive the impedance between the emitter and collector of transistor 270 to a low value. When control electronics 200 determines that any given piston actuator should be fired the respective gate driving one of three lines 278A, 278B, or 278C is changed in state such that the selected transistor 270 has a low impedance from collector to emitter to permit capacitors 272 to discharge through resistor 276 and cause that respective piston actuator to fire.

During self-check no voltage is applied to line 273 from the gate in control electronics 200 and the voltage on charge output line 273 should be lower than 0.6 volt, which is the self-check test voltage, if the circuit elements are correct.

Figure 4:
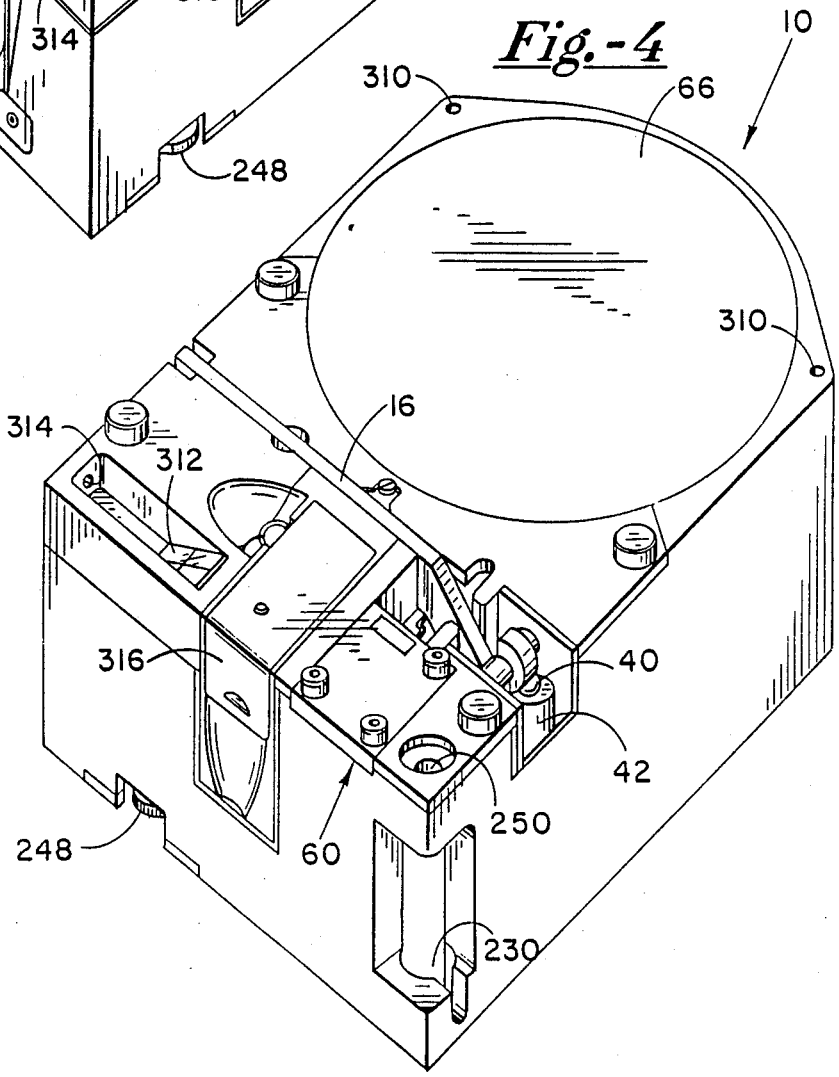
FIG. 4: Munition perspective showing blasting cap receptacle
Figure 5:
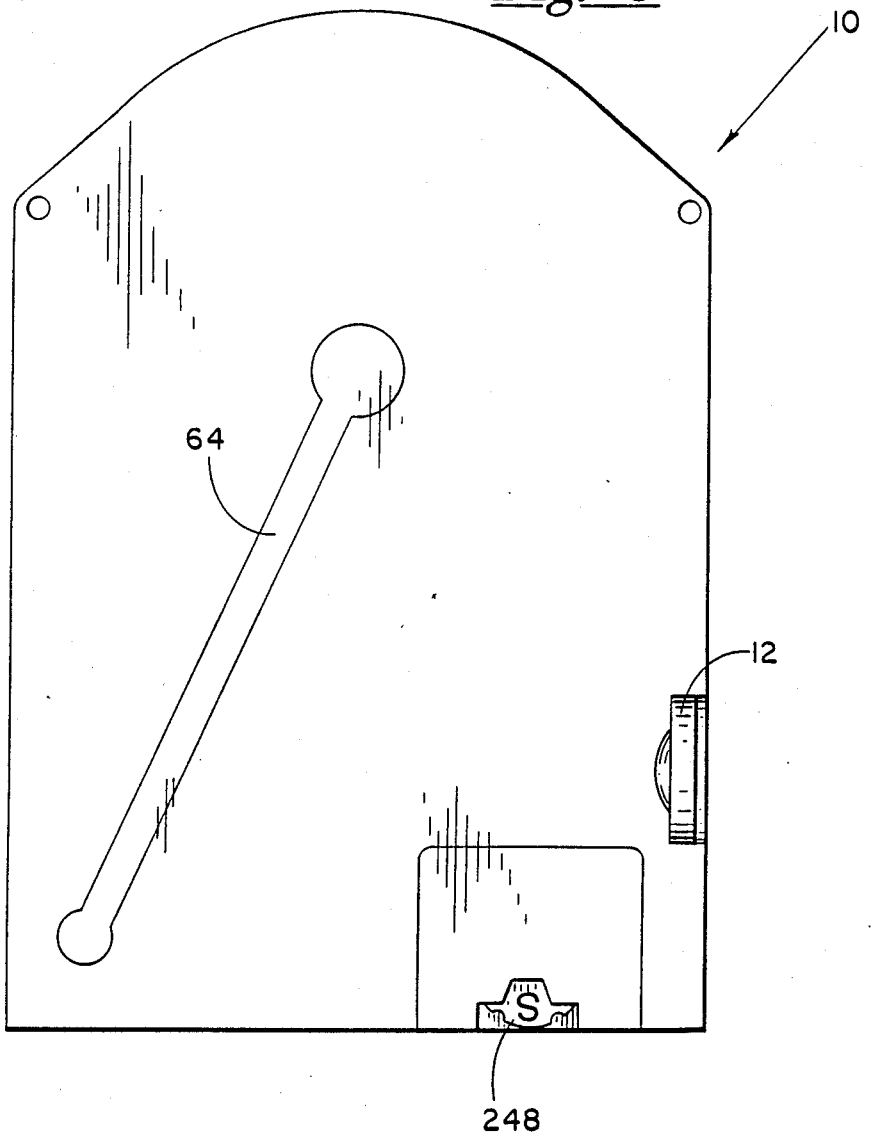
FIG. 5: Bottom view of munition

Tripline switch 258 is contained in a housing 316 shown in FIGS. 3 and 4. A schematic of tripline switch 258 is shown in FIG. 10. When cord 318 is unwound from bobbin 320 and the cord extended, the state of both contacts of tripline switch 258 is changed. One contact changes from closed to open and the other contact changes from open to closed. This is interpreted by the control electronics as tripline deployment as explained earlier. Cord 318 can be deployed alone or attached to another line for greater range. After tripline deployment a pull on cord 318 will change the state of tripline switch 258 back to the original state which is interpreted by the control electronics 200 as either a fire or a tamper input.

Main charge 66, shown in FIG. 6, and warhead liner 240 have matching concave cross-sections. Warhead liner 240 is made of metal. The concave shape of main charge 66 forms and hurls warhead liner 240 along the concave axis. A foam cover 242 provides a protective surface for the warhead liner 240. As discussed earlier, boresight holes 310 are used to align the axis of warhead liner 240 along a desired target path which is followed quite accurately by the warhead liner.

The automatic features provided by the built in control electronics block greatly simplify the operation of the munition mechanical interlocking arming procedures and provide fail safe tests, permit manual selection of a number of operating modes, and select the corresponding input and output circuits based only upon the selected states of two switches.

The use of a single indicator light to indicate successful self-testing, a flashing condition of the light to indicate imminent electronics enabling, the use of no indicating light illumination to indicate a failure condition, the use of an indicator light such that when it subsequently stays off indicates an enabled condition provides all necessary information using only a single indicator with no possibility of a circuit failure in that indicator circuit giving a false safe condition.

All the combined elements of the three applications making up this munition provide a sophisticated system which not only provides a number of electronically controlled modes of operation with resultant flexibility and accuracy but also provides a completely separate external mode of operation. This external mode is available even after the self-sterilization step which not only fires the detonator but provides a positive indication of this fact to permit personnel to safely approach the munition.

The electronics used is state of the art with conventional circuitry for input and output functions and a custom gate array for all other functions. The apparatus is compact and complete.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. A portable munition apparatus comprising:
(a) multiple input means;
(b) manual multiple mode selection means;
(c) multiple firing means for actuator means;
(d) control means providing a number of predetermined operating modes;
(e) power supply means;
(f) status indicator means;
(g) warhead means; and
(h) sighting means.

2. Apparatus as in claim 1 whereby said multiple input means comprises electrical inputs to said control means for external sensing means, including but not limited to, vehicle detection and disturbance detection.

3. Apparatus as in claim 1 whereby said manual multiple mode selection means comprises at least one electrical switching means, which switching status can be established by an operator manually, and which provides a unique electrical signal to said control means for the status of each of the switching states.

4. Apparatus as in claim 1 whereby said multiple firing means comprises at least one electronics circuit arranged such that energy from a logic level output signal can be integrated to provide sufficient energy to fire an actuator means.

5. Apparatus as in claim 1 whereby said control means comprises:
(a) switching means for selecting the desired operating mode;
(b) logic circuitry whereby the status of said switching means can be interpreted to determine the selected operating mode;
(c) control circuitry whereby the appropriate input means and output means corresponding to the selected mode are utilized;
(d) timing means reference means;
(e) timing means whereby a number of timing intervals can be selected corresponding to the requirements of the selected operating mode;
(f) self-checking means;
(g) mode operating means whereby input signals are selected, output signals are selected, timing intervals are selected with the interaction thereof determined and utilized by one of a number of predetermined modes of operation relating to firing and safing the munition established by logic circuitry;

(h) input process means having conditioning means for electrical input signals for logic circuitry use and having storage means to compare existing to earlier input states.

6. Apparatus as in claim 1 whereby said power supply means comprises a reserve battery requiring actuation to energize.

7. Apparatus as in claim 1 whereby said status indicator means comprises a light output means whereby the control means can indicate the operating status of the munition.

8. Apparatus as in claim 1 whereby said warhead means comprises a main charge explosive and an explosively formed projectile.

9. Apparatus as in claim 2 whereby additional said multiple input means comprises a blasting cap placed in close proximity to explosive means, such that when said blasting cap is fired, the firing of said explosive means will result.

10. Apparatus as in claim 2 whereby said vehicle detection comprises magnetic detection means and electronic signal processing and conditioning means, whereby a vehicle detection will result in a logic level signal change.

11. Apparatus as in claim 10 with said disturbance detection comprising a detection switch arranged such that any motion of the munition will result in a change of the detection switch state, and having electronic signal processing and conditioning means whereby a change in the detection switch state will result in logic level signal change.

12. Apparatus as in claim 2 whereby additional said multiple input means comprises a tripline means attached to a switching means.

13. Apparatus as in claim 3 wherein said switching means comprises a manually selectable multiple position switch and a single pole double throw tripline switch providing mode information by indicating tripline deployment status, with said single contact double throw switch wired having a first contact open and a second contact closed prior to tripline deployment and the first contact closed and the second contact open after tripline deployment to inform the control means of the tripline switch status.

14. Apparatus as in claim 4 whereby said firing means comprises firing circuits utilizing a number of capacitors wired in parallel in combination with switching means, arranged such that electrical energy can be integrated over a period of time, and then discharged over a shorter period of time into an explosive piston actuator to detonate said piston actuator.

15. Apparatus as in claim 5 whereby said logic circuitry comprises a portion of a custom gate array arranged to provide the interpretation of the mode selection means by a series of successive logic tests.

16. Apparatus as in claim 5 whereby said input signals are selected and said output signals are selected by means which comprises a portion of a custom gate array utilizing a series of logic elements.

17. Apparatus as in claim 5 whereby said timing means reference means comprises at least two crystal oscillators having nominally equal frequencies of oscillation with a first oscillator providing a clock frequency and a second oscillator providing a means of comparison.

18. Apparatus as in claim 5 whereby said timing means comprises a portion of a custom gate array arranged to provide at least two count down chains, each chain having a number of stages arranged such that the input to each stage is twice the frequency of the output such that, by selecting appropriate stage output combinations any required time interval can be determined.

19. Apparatus as in claim 5 whereby said mode operating means comprises a custom gate array having logic elements interconnected in a predetermined pattern, whereby the mode operating means are secured having the mode determination selection portions and operation portions obtained by preselected logic elements and having the logic elements arranged in a countdown chain providing timing intervals by mode selection of the appropriate combination of countdown stages.

20. Apparatus as in claim 9 wherein explosive means comprises a transfer lead explosive means having a first end adjacent said blasting cap and a second end adjacent a main charge explosive such that an explosive of the transfer lead will explode the main charge explosive.

21. Apparatus as in claim 1 whereby said sighting means has at least one boresight hole completely through a case holding a main charge having a concave face and adjacent to a mating warhead liner, the boresight hole being aligned with the axis of concavity such that the warhead liner is aimed using the boresight hole.

22. Apparatus as in claim 21 wherein the case has a hole in a surface perpendicular to the boresight hole and extending partially through the case from the surface adjacent the warhead liner to an exposed reflective surface set at a 45 degree angle with respect to the hole and to the warhead liner; the reflective surface having crosshairs arranged such that the hole and crosshairs can be used to aim the warhead liner from the side of the munition.

23. Apparatus as in claim 7 wherein said light output means comprises a light emitting diode.

24. Apparatus as in claim 5 whereby said self-checking means further comprises firing circuit capacitors and means to test voltage across said firing circuit capacitors; first and second crystal oscillator means operating at first and second frequencies, respectively; low battery voltage detection means for comparing the first and second crystal oscillator frequencies to determine whether the first crystal oscillator is faster or slower than the second crystal oscillator; piston actuators and means for testing for missing and open circuited piston actuators; a single pole double throw tripline switch having two contacts and a check means to determine that both contacts of the tripline switch are not of the same state; a multiple position switch and a test means to determine the multiple position switch status.

* * * * *